US005225803A

United States Patent [19]

Negle et al.

[11] Patent Number: 5,225,803

[45] Date of Patent: Jul. 6, 1993

[54] HIGH VOLTAGE TRANSFORMER, NOTABLY FOR AN X-RAY APPARATUS

[75] Inventors: Hans Negle, Nahe; Alfred Sachsse; Martin Wimmer, both of Hamburg, all of Fed. Rep. of Germany

[73] Assignee: U.S. Philips Corporation, New York, N.Y.

[21] Appl. No.: 725,149

[22] Filed: Jul. 3, 1991

[30] Foreign Application Priority Data

Jul. 6, 1990 [DE] Fed. Rep. of Germany ..... 4021585

[51] Int. Cl.[5] ..... H01F 27/30

[52] U.S. Cl. ..... 336/208; 336/145; 336/185

[58] Field of Search ..... 336/145, 180, 185, 195, 336/196, 198, 199, 208

[56] References Cited

U.S. PATENT DOCUMENTS

| | | | |
|---|---|---|---|
| 3,665,288 | 5/1972 | Godawski | 336/69 |
| 3,813,574 | 5/1974 | Sato | 315/29 |
| 4,227,143 | 10/1980 | Elders et al. | 323/48 |
| 4,338,657 | 7/1982 | Lisin et al. | 363/68 |
| 4,586,016 | 4/1986 | Rilly et al. | 336/96 |
| 4,609,900 | 9/1986 | Bachhofer et al. | 336/58 |
| 4,814,733 | 3/1989 | Menge | 336/69 |
| 4,967,121 | 10/1990 | Nero | 315/411 |
| 4,982,498 | 1/1991 | Umezaki | 29/602.1 |
| 5,123,038 | 6/1992 | Negle et al. | 378/101 |

FOREIGN PATENT DOCUMENTS 1259104 3/1961 France .

OTHER PUBLICATIONS

Soviet Inventors Illustrated Derwent Publications Ltd. London GB Week 8834, Oct. 5, 1988 & SU-A-1372391 (Lengo Burevestnik).

*Primary Examiner*—Leo P. Picard
*Assistant Examiner*—Bot Ledynh
*Attorney, Agent, or Firm*—Bernard Franzblau

[57] ABSTRACT

A high-voltage transformer, for an X-ray apparatus includes a high-voltage winding (4) which consists of at least one coil (5) which is supported by an insulating member (6). Heat dissipation from the coil is improved in that the coil is wound so as to be self-supporting and have a stable shape without requiring the use of supporting members and/or intermediate insulating elements, a small part of its surface being connected to the insulating member so that the greatest part of its surface is situated a distance from the walls of the insulating member.

22 Claims, 1 Drawing Sheet

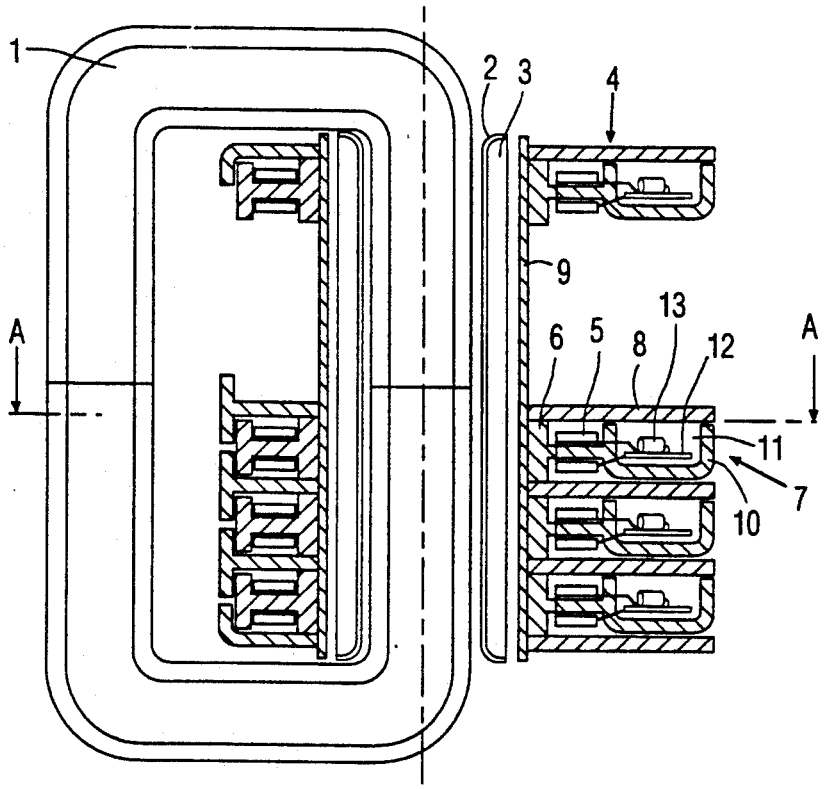
FIG. 1
FIG. 1a
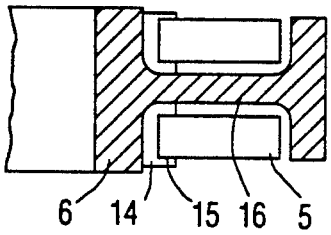
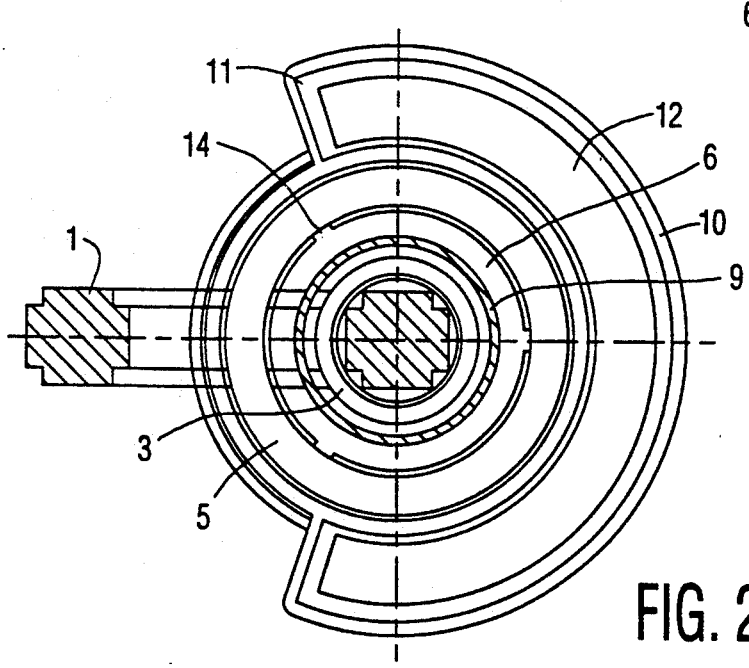
FIG. 2

HIGH VOLTAGE TRANSFORMER, NOTABLY FOR AN X-RAY APPARATUS

BACKGROUND OF THE INVENTION

This invention relates to a high-voltage transformer, notably for an X-ray apparatus, comprising a high-voltage winding which comprises at least one coil which is supported by an insulating member.

X-ray generators utilize so-called converter generators for generating the necessary high voltage, said converter generators requiring high-voltage transformers operating at frequencies of, for example, 10 kHz. Such transformers require substantially less material and manufacturing effort than 50 Hz transformers. The aim is to achieve as high as possible power densities in order to obtain higher continuous power outputs for a given volume or to reduce the volume for the same power. Therefore, effective steps must be taken for the cooling of the coils. When the operating frequencies are increased, higher losses also occur in the form of copper supplementary losses due to current displacement.

A device of the kind set forth is known from EP-A 84 912 which corresponds to U.S. Pat. No. 4,545,005 Oct. 1, 1985. Therein, wire turns of the coil formers are wound directly in winding chambers of insulating members. Such insulating members are customarily made of moulding resin. Almost the entire coil is enclosed by material having a poor thermal conductivity. Consequently, in the case of high loss power densities, accumulation of heat occurs in the coil and in the insulating member which are thus exposed to a high thermal load.

SUMMARY OF THE INVENTION

It is an object of the invention to construct a device of the kind set forth which is arranged so that the dissipation of heat is improved, thus enabling a higher continuous power output.

This object is achieved in that the coil is wound so as to be self-supporting and to have a stable shape without requiring the use of supporting members or intermediate insulating elements, a small part of the surface of the coil being connected to the insulating member so that the greatest part of its surface is situated a distance from the walls of the insulating member.

A coil constructed in accordance with the invention need not be supported by the walls of the insulating member on all sides. Support by small areas of an insulating member is sufficient, so that a substantially larger part of the surface of the coil remains freely accessible to a cooling medium such as oil.

When turns are directly wound into winding spaces of an insulating member, irregular winding configurations occur due to the substantial dimensional tolerances of the coil formers. As a result, substantial deviations occur in the winding capacitances. Notably, however, turns of a layer are liable to be pressed into a layer situated therebelow. As a result, the layer voltage acting on such a turn can be multiplied. In order to prevent this effect, thus far intermediate insulation layers were provided between the layers of turns. This is a drawback especially when comparatively high operating frequencies are used for which the secondary high voltage is distributed between substantially fewer turns. High turn voltages then occur between two turns which neighbour one another in a layer and consequently higher layer voltages also occur between the turns of oppositely situated layers. Therefore, in order to increase the insulation strength of the high-voltage winding, the coil is wound in an orthocyclic manner.

The individual turns of an orthocyclic winding extend in a plane orthogonal to the winding axis over the greatest part of their length and are guided to the plane of the next turn in a small circumferential zone. Using an appropriate winding technique, it is achieved that each turn occupies an accurately predetermined position (see Philips Technische Rundschau 1962, no. 12, pp. 401 to 404). In accordance with the invention, self-supporting orthocyclic coils are constructed using winding tools which have narrow tolerances and wherefrom they can be removed, for example, after an impregnation operation, so that they have a stable shape. Thus, it is ensured that the coils have an ideal, regular construction also after integration into the high-voltage transformer. Breakdowns due to turns extending in an uncontrolled manner are avoided. The winding capacitances and the stray inductances are virtually the same in coils manufactured in bulk, so that these values, which cooperate with external capacitors used for generating the high voltage, can be considered to be fixed values without tolerances.

The coil can be frictionally retained on a mandrel of an insulating member. It can alternatively be secured by means of an adhesive.

In a preferred, simple embodiment the coils are form-locked to the insulating members. Suitable form-locking can be achieved by thermal deformation of receiving projections on the insulating member.

A preferred solution is characterized in that the form-locked coupling is realized so that the greatest part of the surface of the coil is situated a small distance from neighbouring walls of the insulating member. The greatest part of the coil surface then freely contacts a cooling medium such as oil, so that very effective cooling is achieved.

A stable, self-supporting coil configuration is obtained when the turns of the coil are bonded to the neighbouring turns. It is not necessary to apply an adhesive during the winding operation when the coil is wound using baking enamelled wire whose outer insulating layer consists of a synthetic material which melts under the influence of heat and which is "baked" to the outer insulating layer of the neighbouring turns. Preferably, the high-voltage winding comprises several coils which are supported by separate, similar insulating members. In that case only a corresponding fraction of the overall high-voltage need be taken into account for the insulation of each coil. Narrow and high coils are particularly attractive in view of insulating strength and dissipation of heat.

When the high-voltage winding consists of several coils, the latter can be constructed, like the associated insulating members, as standard components which are suitable for a whole series of high-voltage transformers. The assembly of high-voltage transformers having different voltage and power ratings can be realised using similar components and only a few operations.

In a preferred embodiment, two coils are provided on one insulating member. When the two coils are arranged one on each side of a separating flange of the insulating member, the two coils are insulated from one another and need only be insulated with respect to the voltage present across each coil.

When the high-voltage winding consists of several, similar coils, the voltages thereof can be connected in series directly or after rectifying. The necessary electrical connections can then be very simply realized by providing the insulating members with connector elements for electrical connection to similar, neighbouring insulating members.

In a preferred embodiment of the invention, the insulating members are provided with radial external projections on which electrical components such as capacitors, resistors and rectifiers can be mounted and wired to coils supported by the insulating member. The components to be connected to a coil or a pair of coils are then situated in the immediate vicinity of the coil, resulting in short connection paths. The necessary insulation is then reduced because the insulating paths for the coils also suffice for the components which are loaded by the voltage in the same way.

The radial projections may form part of the insulating members but may also be separate components such as, for example, printed wiring boards. The electrical components may be of a conventional type or may also be SMD elements.

In a particularly attractive embodiment of the invention, a damping resistor which is to be arranged in the circuit of an X-ray tube is formed by sub-resistors which are distributed between the projections of the individual insulating members. In the past, a single damping resistor was provided whose insulation had to be proportioned for the entire high voltage. This resulted in complex and voluminous damping resistors. In accordance with the invention, however, only a corresponding part of the high voltage acts on the sub-resistors. The insulation thereof may be less heavy. Because of their small volume, they can be readily accommodated on mounts provided on the insulating members because the insulating paths present can be used in common.

The material, the shape and the method of manufacturing the insulating members can be chosen at random, bearing in mind a suitable insulation strength.

Insulating members comprising coils can be simply combined as similar modules to form a high-voltage winding when the insulating members comprise form-locking elements for a mutual, notably a latching connection.

BRIEF DESCRIPTION OF THE DRAWINGS

The invention will be described in detail hereinafter with reference to the accompanying drawing, in which:

FIG. 1 is a longitudinal sectional view of a winding, provided on a U-core, of a high-voltage transformer for an X-ray apparatus, FIG. 1*a* is a cross-sectional view at an increased scale of an insulating member provided with coils, and FIG. 2 is a cross-sectional view, taken along the line A—A, of the device shown in FIG. 1.

DESCRIPTION OF THE PREFERRED EMBODIMENTS

A limb of the two-part ferromagnetic core 1 supports the primary winding 3, wound onto a moulded coil former 2, and the secondary high-voltage winding 4 which comprises a plurality of similar coils 5. Each pair of coils 5 constitutes, in conjunction with an insulating member 6 supporting the coils, a winding module 7. A number of such similar winding modules 7 is threaded onto an insulating supporting sleeve 9, the modules being separated by intermediate insulating discs 8.

The insulating members 6 are provided with radially extending, external projections 10 which form a ring segment chamber 11 in which a supporting segment 12 for accommodating an electrical circuit element 13 is secured. The circuit elements 13 are not shown in FIG. 2.

The electrical circuit elements 13 are associated with the series-connected coils 5 of each insulating member 6. These circuit elements are notably diodes for rectifying the alternating voltage of the coils 5 and also any smoothing capacitors that may be required. The DC voltages of the module 7 in series form the secondary DC high voltage for an X-ray tube.

Damping sub-resistors are also provided on the supporting segment 12. The damping resistance required in the circuit of an X-ray tube in order to prevent excessive anode currents is distributed between a number of sub-resistors which corresponds to the number of modules 7 and whose insulation need each time be adapted to only a fraction of the overall high voltage. Thus, far more space was required for a single, large and complex damping resistor, but in the less expensive configuration in accordance with the invention only an insignificant amount of space is required. External and high-voltage resistant connections are dispensed with.

FIG. 1*a* is a cross-sectinal view at an increased scale of a supporting member 6 and the coils 5 arranged thereon at the area of the window of the transformer core (at the left in FIG. 1).

The cross-section of the supporting member is shaped as a double-T and forms two ring segment chambers accommodating the coils 5. In accordance with the invention, the coils 5 are orthocyclically wound so as to be self-supporting. They are wound using baking enamelled wire, in a high-precision winding tool with exactly defined wire guiding. Baking can take place either during winding, for example, by means of hot air or infrared radiation, or by heating after winding. Subsequently, the coils 5 are removed from the winding mandril as units having a stable shape.

The coils are slid onto three narrow supporting projections 14 of the insulating member 6 of moulded thermoplastic synthetic material and are secured with a clearance from the walls of the insulating member 6 by melting of the material of the supporting projections (raised portion 15). As a result, substantially the entire surface of the coil 5 is freely accessible to circulating oil which cools by convection.

We claim:

1. A high-voltage transformer for an X-ray apparatus comprising: a high-voltage winding which comprises at least one coil which is supported by an insulating member, characterized in that the coil is wound so as to be self-supporting and to have a stable shape without the use of supporting members and/or intermediate insulating elements, a small part of the surface of the coil being connected to the insulating member so that the greatest part of its surface is situated at a distance from walls of the insulating member.

2. A high-voltage tranformer as claimed in claim 1, wherein the coil is orthocyclically wound.

3. A high-voltage transformer as claimed in claim 2, wherein the turns of the coil are bonded to neighbouring turns.

4. A high-voltage transformer as claimed in claim 2, wherein the high-voltage winding comprises a plurality of coils which are supported by separate, similar insulating members.

5. A high-voltage transformer as claimed in claim 2 comprising a plurality of insulating members which include radially extending, external projections on which electrical components are mounted and wired to coils supported by the insulating member.

6. A high-voltage transformer as claimed in claim 5 wherein a damping resistor, which is to be included in the circuit of an X-ray tube, comprises a plurality of distributed sub-resistors which are mounted on the projections of the individual insulating members.

7. A high-voltage transformer as claimed in claim 2 wherein said coil is connected to the insulating member in a manner so as to provide a space between an outer surface of the insulating member and an inner surface of the coil for the greatest part of said inner surface of the coil.

8. A high-voltage transformer as claimed in claim 2, wherein the coil is form-locked to the insulating member.

9. A high-voltage transformer as claimed in claim 1 wherein the turns of the coil are bonded to neighbouring turns.

10. A high-voltage transformer as claimed in claim 9, wherein the wound coil comprises baking enamelled wire including insulation meltable under the influence of heat so that said neighboring turns are bonded by being baked to one another.

11. A high-voltage transformer as claimed in claim 1 wherein the high-voltage winding comprises a plurality of coils which are supported by a plurality of separate, similar insulating members.

12. A high-voltage transformer as claimed in claim 11 wherein the insulating members are injection-moulded components.

13. A high-voltage transformer as claimed in claim 11 wherein the insulating members comprise form-locking elements providing a latching interconnection of the insulating members.

14. A high-voltage transformer as claimed in claim 11 further comprising a low-voltage winding mounted within the high-voltage winding, and an insulating support sleeve positioned between the low-voltage and high-voltage windings and with the insulating members mounted thereon.

15. A high-voltage transformer as claimed in claim 1 wherein two coils are provided on one insulating member.

16. A high-voltage transformer as claimed in claim 15, wherein the two coils are situated one on each side of a separating flange of the insulating member.

17. A high-voltage transformer as claimed in claim 1 comprising a plurality of insulating members which include radially extending, external projections on which electrical components are mounted and wired to coils supported by the insulating member.

18. A high-voltage transformer as claimed in claim 17, wherein a damping resistor, which is to be included in the circuit of an X-ray tube, comprises a plurality of distributed sub-resistors which are mounted on the projections of the individual insulating members.

19. A high-voltage transformer as claimed in claim 1, wherein the coil is form-locked to the insulating member.

20. A high-voltage transformer as claimed in claim 1 wherein the insulation member comprises a circular outer surface from which radially extend a plurality of projection elements located about the periphery of said circular outer surface, and wherein said coil is supported on the projection elements such that a circular space is provided between said circular outer surface of the insulation member and the coil thereby to allow a liquid cooling medium to circulate within said circular space.

21. A high-voltage transformer as claimed in claim 1 wherein said at least one coil is ring-shaped and has a uniform width from bottom winding to top winding thereof.

22. A high-voltage transformer as claimed in claim 1 which further comprises a magnetic core with a low-voltage winding supported thereon and the high-voltage winding comprises a plurality of electrically distinct coils arranged on respective insulating members arranged side-by-side sequentially along said magnetic core so as to surround at least a part of the low-voltage winding.

* * * * *